United States Patent [19]

McGinnis

[11] Patent Number: 4,808,025

[45] Date of Patent: Feb. 28, 1989

[54] TEMPORARY DEVICE FOR USE DURING STREET REPAIRS

[76] Inventor: Robert E. McGinnis, 13809 Polk St., Omaha, Nebr. 68137

[21] Appl. No.: 88,088

[22] Filed: Aug. 21, 1987

[51] Int. Cl.[4] ..... E02D 29/14

[52] U.S. Cl. ..... 404/26; 404/35; 404/32

[58] Field of Search ..... 404/25, 26, 35, 32, 404/40; 14/69.5, 71.1; 15/215; 238/8

[56] References Cited

U.S. PATENT DOCUMENTS

| | | | |
|---|---|---|---|
| 815,649 | 3/1906 | Smith | 404/35 X |
| 1,096,701 | 5/1914 | Emsley | 404/25 |
| 1,673,630 | 6/1928 | Madge | 404/32 |
| 3,326,100 | 6/1967 | White | 404/26 |
| 3,426,659 | 2/1969 | Clarke et al. | 404/25 |
| 3,968,600 | 7/1976 | Bowman | 52/19 |
| 4,187,647 | 2/1980 | Hall | 52/20 |
| 4,365,743 | 12/1982 | Trickel et al. | 238/8 |
| 4,466,219 | 8/1984 | Campolito | 52/20 |
| 4,746,243 | 5/1988 | Perry | 404/35 |

*Primary Examiner*—Stephen J. Novosad
*Assistant Examiner*—Matthew Smith
*Attorney, Agent, or Firm*—Zarley, McKee, Thomte, Voorhees & Sease

[57] ABSTRACT

A temporary device is used for street repair work to provide a ramp between the ground roadway surface and the upper end of such structures as manhole supports, storm sewer inlet grates, etc. The device of this invention is secured to the roadway by a plurality of stakes driven downwardly through the device and embedded in the roadway.

11 Claims, 3 Drawing Sheets

TEMPORARY DEVICE FOR USE DURING STREET REPAIRS

BACKGROUND OF THE INVENTION

Occasionally, it is necessary to resurface city streets. In some cases, a portion of the old street or roadway is ground away to provide a suitable base for the new surface. When a portion of the old street has been removed, manhole covers and their supports, present in the street, protrude upwardly from the ground surface thereby creating a hazard to vehicles. The same is also true for the metal grates positioned outwardly of storm sewer inlets. To protect the vehicles from damage which could occur if the vehicle strikes the manhole support or storm sewer grate, barricades are normally erected around the supports and grates thereby creating traffic bottlenecks.

When the street has been resurfaced, the resurfacing material, which is usually asphalt, covers the manhole supports, manholes and the storm sewer grates. Workmen then chip away the asphalt material from the manhole supports and the grates thereby creating holes in the new surface until workmen are able to repair the same. In such a case, barricades are normally also erected around the manholes and storm sewer grates until the workmen have had an opportunity to repair the surface.

It is therefore a principal object of this invention to provide a temporary device which may be used with manhole supports, storm sewer inlet grates, etc. during street repair operations to eliminate the necessity of erecting barricades around the same.

A further object of the invention is to provide a temporary device which may be used with a manhole support comprising a resilient ramp positioned around the manhole support to provide cushion contact between a vehicle wheel and the manhole support.

Still another object of the invention is to provide a temporary device for use with a storm sewer inlet grate or the like comprising a resilient ramp member having an opening formed therein adapted to receive the grate to cushion contact between a vehicle wheel and the grate during street repair operations.

Yet another object of the invention is to provide a temporary device which may be used in connection with manhole supports, inlet grates, etc. during street repair operations including means for securing the device to the roadway.

Yet another object of the invention is to provide a temporary device of the type described which is economical of manufacture, durable in use and refined in appearance.

These and other objects will be apparent to those skilled in the art.

SUMMARY OF THE INVENTION

The cushioning device of this invention is designed to be used during street repair operations to prevent damage to a vehicle should the vehicle come into contact with the manhole support, storm sewer inlet grate, etc. When a roadway surface has been ground down, the device of this invention is positioned around the manhole supports and storm sewer inlet grate and secured to the roadway to prevent movement thereof. The device comprises a flat resilient member having an opening formed therein for receiving a manhole support, grate, etc. with the cushioning device being comprised of a resilient material to cushion vehicle wheel contact. The cushioning device is secured to the roadway by means of a plurality of stakes driven downwardly through the cushioning device and into the roadway. Each of the stakes is provided with a resilient head portion thereon to prevent damage to vehicle tires. The head of the stakes is also provided with a means for removing the stake from the roadway. The device may also be used after the roadway has been resurfaced and the new surface has been removed around a manhole support, etc.

DESCRIPTION OF THE PREFERRED EMBODIMENT

Figure 1:
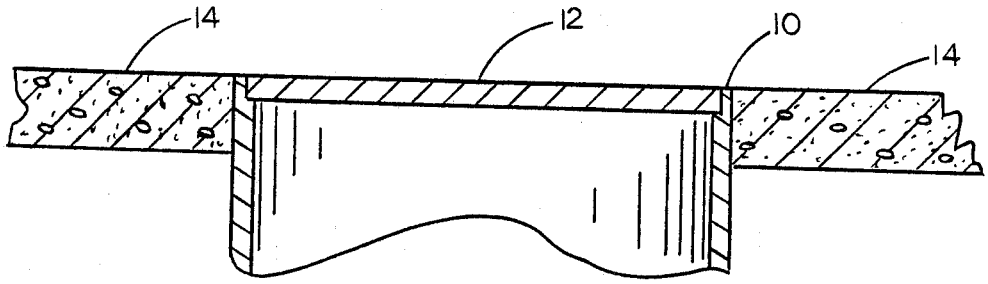
FIG. 1 is a sectional view through a street with a manhole prior to road construction.
Figure 2:
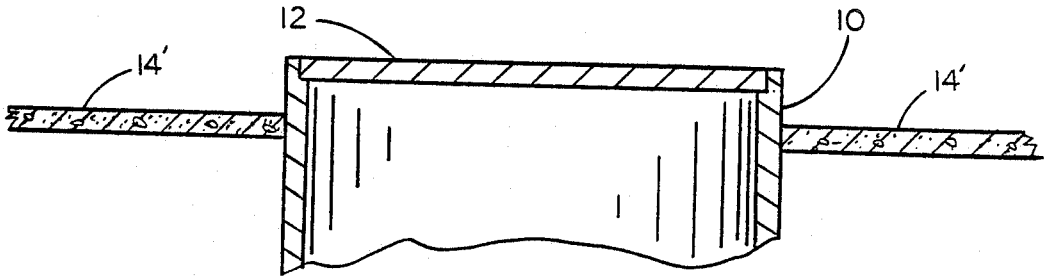
FIG. 2 is a sectional view similar to FIG. 1 but with the street surface ground away around the manhole.
Figure 3:
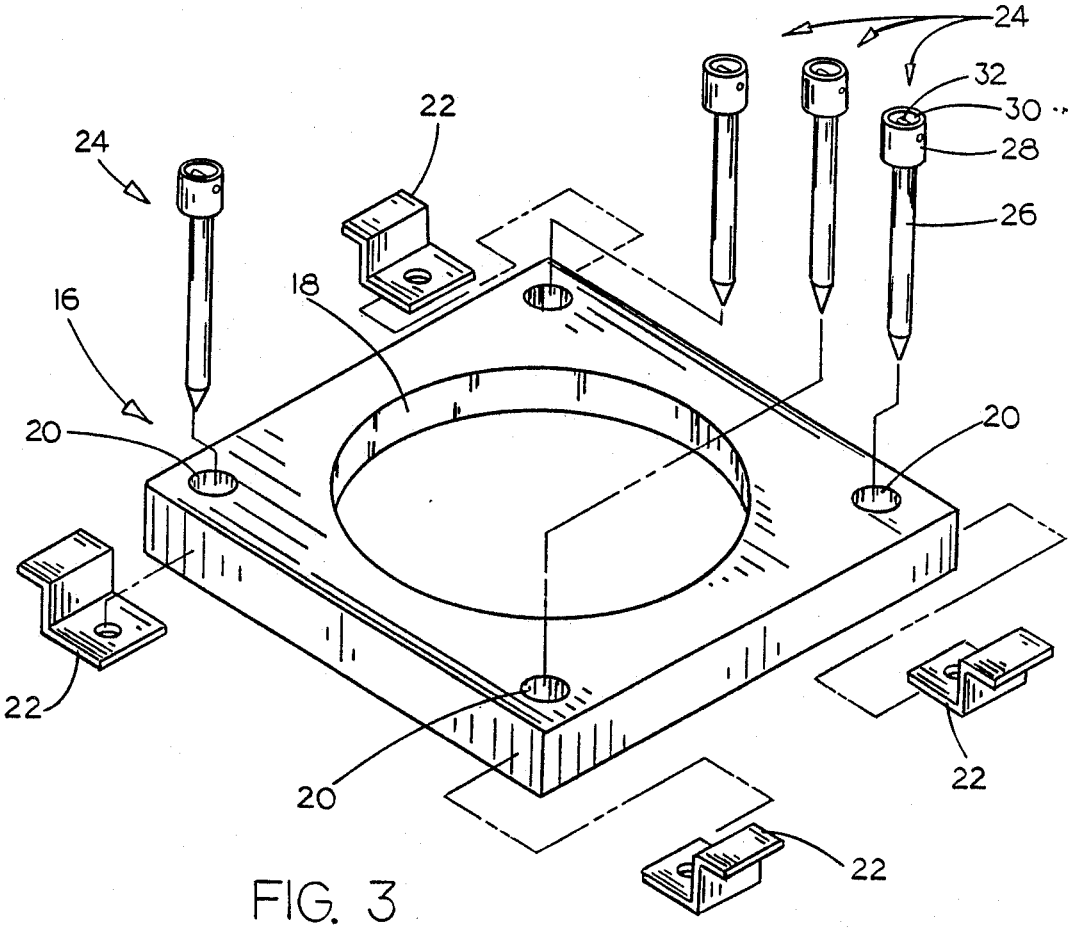
FIG. 3 is a perspective view of the device of this invention.

The cushioning device of this invention is primarily intended for use in combination with a manhole support but is equally well-suited for use with a storma sewer inlet grate as will be described hereinafter. In FIG. 1, the numeral 10 refers to a manhole support having manhole cover 12 positioned therein. FIG. 1 illustrates the top surface of the roadway 14 being approximately at the same plane as the upper end of the manhole support 10. FIG. 2 illustrates the relationship of the manhole support 10 after the roadway 14 has been partially ground away so that a new surface may be placed thereon. As seen in FIG. 2, the upper end of the manhole support 10 dwells above the ground roadway surface 14'. Once the roadway 14 has been ground to the level as illustrated in FIG. 2, it has been heretofore necessary to erect barricades around the manhole cover so that vehicles will not be damaged when they strike the exposed manhole support 10. To eliminate such a problem, a cushioning device or pad 16 is provided. Although FIG. 3 illustrates pad 16 as being approximately square, the pad could be rectangular or circular, if so desired. Pad 16 is comprised of a resilient foam material and has a central opening 18 formed therein which is adapted to receive the manhole support 10. Pad 16 is provided with a plurality of openings 20 extending downwardly therethrough which have reinforcing members 22 embedded therein.

Figure 4:
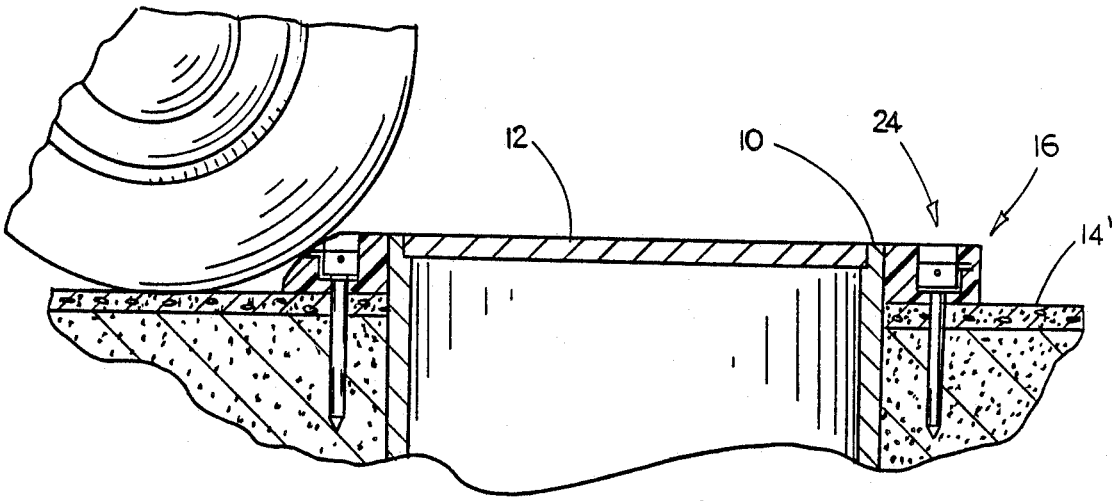
FIG. 4 is a sectional view of the invention in place around a manhole.
Figure 5:
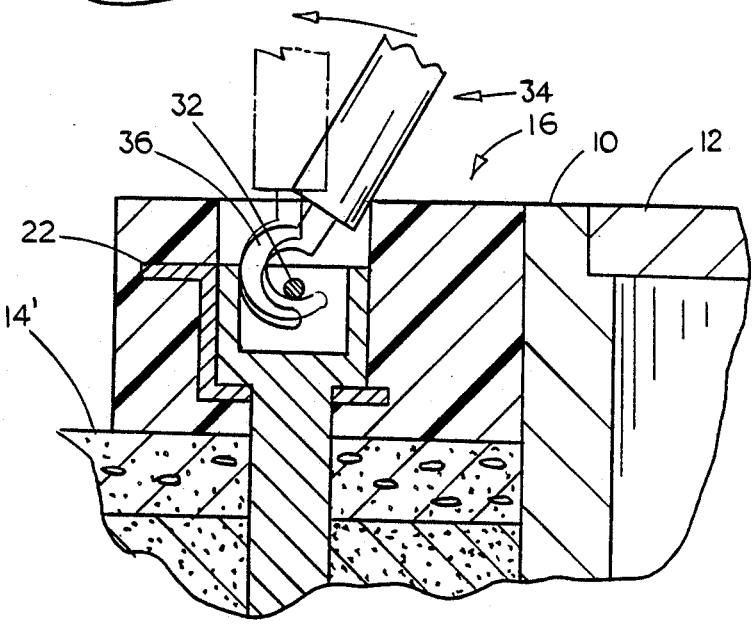
FIG. 5 is an enlarged sectional view of a portion of FIG. 4.

To eliminate the necessity of erecting barricades around the exposed manhole support 10 of FIG. 2, pad 16 is positioned so that opening 18 receives manhole support 10 (see FIG. 4). It is preferred that the thickness of the pad 16 be substantially the same as the vertical difference between the exposed upper surface of the ground roadway 14' and the upper end of manhole support 10. Pad 16 is preferably secured in position by means of stakes 24 which are extended through openings 20 and driven into the roadway to anchor the pad 16 in place.

As seen in the drawings, each of the stakes 24 includes a shank portion 26 having a resilient head portion 28 provided thereon. Head portion 28 is provided with a recess 30 in its upper end to provide access to the pin 32 which extends through the head portion 28. The purpose of the resilient head portion 28 is to prevent tire damage to vehicles coming into contact with the upper ends of the stakes as the vehicle passes over the ramp 16.

It can be seen that the resilient pad 16 provides a ramp between the ground roadway 14' in the upper end of the manhole support so that vehicles can pass over the manhole support and the manhole cover without damaging the tires thereof. When the pad 16 is no longer needed, the stakes 24 are removed by means of the tool 34 having hook 36 on the lower end thereof. Hook 36 is extended downwardly into recess 30 and brought into engagement with the pin 28. Upward movement of the tool 34 will cause the stake 24 to be removed from the roadway thereby permitting the ramp 16 to be removed.

Figure 6:
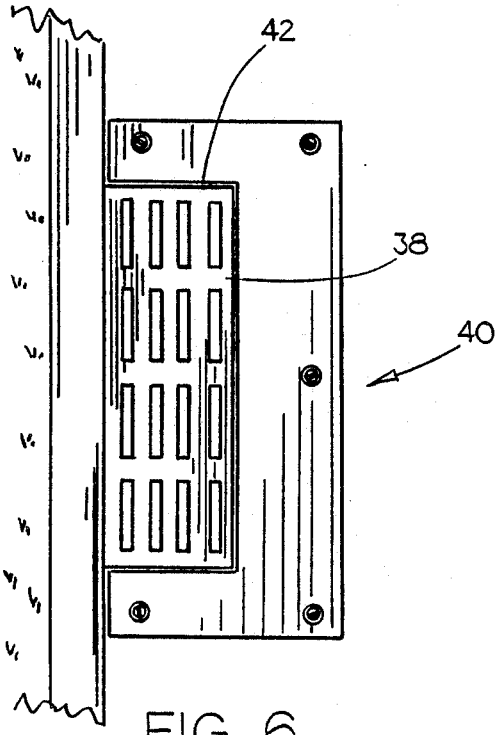
FIG. 6 is a top view of a second embodiment of the invention.
Figure 7:
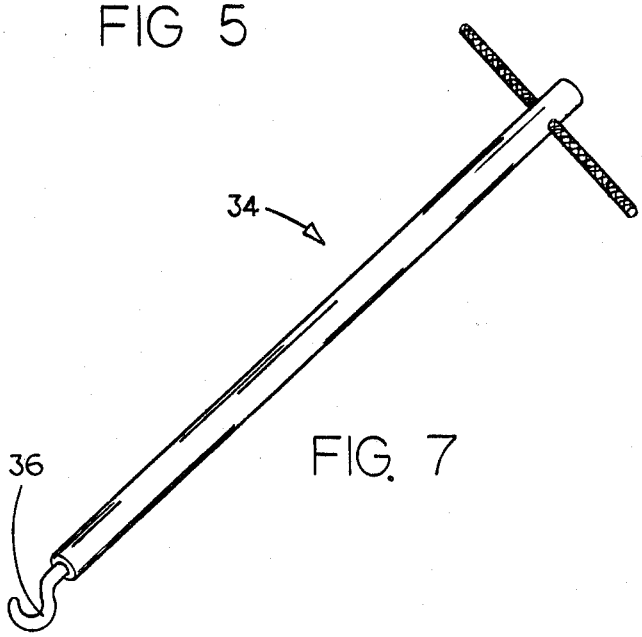
FIG. 7 is a perspective view of a tool for removing the device from the road surface.

A modified form of the invention is illustrated in FIG. 6 and is designed to create a cushioning device for the metal grates 38 on a storm sewer inlet. Pad 40 as seen in FIG. 6 is designed for the same purpose as the pad 16 except that it has a different configuration to accommodate the grate 38. Pad 40 includes an angular opening 42 at one side thereof which is adapted to receive the grate 38 as illustrated in the drawings. Thus it can be seen that the cushioning device of this invention may assume any configuration corresponding to the type of obstruction that is present during street repair work.

Figure 8:
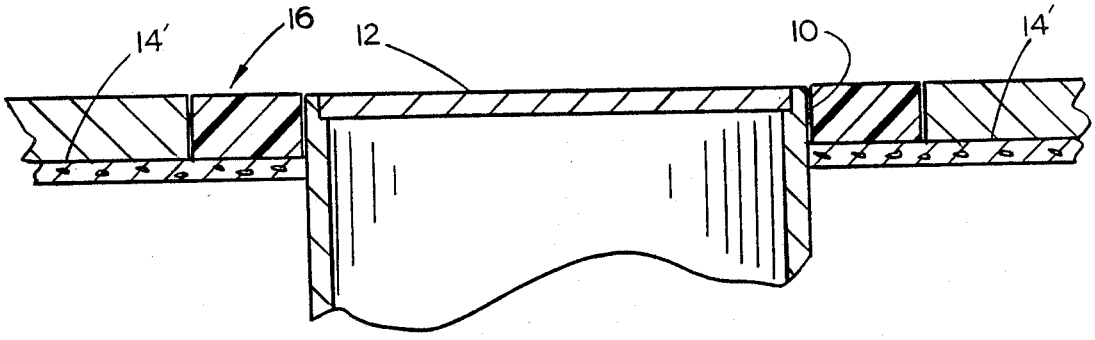
FIG. 8 is a sectional view of the invention in place around a manhole.

FIG. 8 illustrates the pad 16 temporarily installed around a manhole support after the roadway has been resurfaced and the same has been chipped away around the support. It can therefore be seen that the invention accomplishes at least all of its stated objectives.

I claim:

1. A temporary device for use with a manhole support positioned in a roadway which has been partially ground down for resurfacing with the grinding of the roadway causing the periphery of the manhole support to be elevated above the ground surface of the roadway, comprising, a flat, resilient temporary ramp member having a thickness approximately equal to the vertical difference between the upper end of the manhole support and the ground surface of the roadway, said ramp member having a central opening formed therein adapted to receive the manhole support therein whereby said ramp member may be temporarily positioned on the ground roadway around the manhole support to cushion contact between a vehicle wheel and the manhole support prior to the roadway being resurfaced, and means temporarily securing said ramp member relative to the manhole support, said securement means adapted to temporarily, removably secure said ramp to said ground prior to resurfacing of said ground roadway.

2. The device of claim 1 wherein said means securing said ramp member relative to the manhole support comprises a plurality of stakes extending downwardly through said ramp member into the roadway.

3. The device of claim 2 wherein said stakes have a resilient head portion provided thereon.

4. The device of claim 2 wherein said stakes have means associated therewith for assisting in the removal of the stakes.

5. The device of claim 4 wherein said means comprises a recessed, horizontally disposed pin means.

6. The device of claim 1 wherein said ramp member has a generally square configuration.

7. A temporary device for use with a storm sewer inlet grate positioned in a roadway which has been partially ground down for resurfacing with the grinding of the roadway causing the upper surface of the grate to be elevated above the ground surface of the roadway, comprising, a flat, resilient temporary ramp member having a thickness approximately equal to the vertical difference between the upper surface of the grate and the ground surface of the roadway, said ramp member having an opening formed therein adapted to receive the grate therein whereby said ramp member may be temporarily positioned on the ground roadway adjacent the grate to cushion contact between a vehicle wheel and the grate prior to the roadway being resurfaced, and means temporarily securing said ramp member relative to the grate, said securement means adapted to temporarily, removably secure said ramp to said ground prior to resurfacing of said ground roadway.

8. The device of claim 7 wherein said means comprises a plurality of stakes extending downwardly through said ramp member into the roadway.

9. The device of claim 2 wherein said stakes include a shank portion and a resilient head portion, said head portion having a recessed opening in its upper end and a horizontally disposed pin mounted therein.

10. A temporary device for use with a manhole support positioned in a roadway, comprising, a flat, resilient pad member, said pad member having a central opening formed therein adapted to receive the manhole support therein whereby said pad member may be temporarily positioned on the roadway around the manhole support to cushion contact between a vehicle wheel and the manhole support, and means temporarily, removably securing said pad member relative to the manhole support.

11. A temporary device for use with a storm sewer inlet grate positioned in a roadway, comprising, a flat, resilient pad member, said pad member having an opening formed therein adapted to receive the grate therein whereby said pad member may be temporarily positioned on the roadway adjacent the grate to cushion contact between a vehicle wheel and the grate, and means temporarily, removably securing said pad member relative to the grate.

* * * * *